United States Patent [19]

Sheppard et al.

[11] Patent Number: 4,974,263

[45] Date of Patent: Dec. 4, 1990

[54] LID ACTUATED TOILET FLUSHING SYSTEM

[76] Inventors: Mark Sheppard; Lynda Timbers, both of 107 E. St., Roseville, Calif. 95678

[21] Appl. No.: 383,582

[22] Filed: Jul. 14, 1989

[51] Int. Cl.[5] ..... E03D 5/04

[52] U.S. Cl. ..... 4/250

[58] Field of Search ..... 4/249, 250, 408, 409

[56] References Cited

U.S. PATENT DOCUMENTS

| | | | |
|---|---|---|---|
| 311,587 | 2/1885 | Keyworth | 4/250 X |
| 582,430 | 5/1897 | McKay | 4/249 |
| 3,579,664 | 5/1971 | Johnson | 4/250 |

FOREIGN PATENT DOCUMENTS

| | | | |
|---|---|---|---|
| 295941 | 1/1954 | Switzerland | 4/250 |

*Primary Examiner*—Charles E. Phillips

*Attorney, Agent, or Firm*—Mark C. Jacobs

[57] ABSTRACT

A lid actuated toilet flushing system wherein a conventional flushing flapper valve is actuated by a pull chain controlled by the positioning of the lid fo the toilet. The lid must be moved from the up to the down position to flush the toilet and a ratchet mechanism is provided for completing flushing of the toilet even if the lid is left in the down position.

Moving the lid actuates a pawl (flush lever) which rotates a tooth (trip lever) which trip lever is connected to a conventional flusing rod and other elements interposed between the flusing rod and a flapper valve.

10 Claims, 3 Drawing Sheets

IX
IX

LID ACTUATED TOILET FLUSHING SYSTEM

BACKGROUND OF THE INVENTION

1. Field of the Invention

The invention relates to flushing toilets; and, more particularly, to a lid actuated toilet flushing system.

2. Description of the Prior Art

Automatic flushing toilets are of course well known in the art. In the past, it has been suggested to modify such toilets to flush the same using movement of the toilet lid. This avoids the problem of someone sitting down on the toilet when the seat is up. However, most such prior art devices, as in U.S. Pat. Nos. 657,278; 1,083,815; 1,605,939; 1,919,700; 2,428,685; 3,590,397; and 4,573,223 all require that the toilet be modified to accomplish the effect desired. That is, Such systems are not readily adaptable to a preexisting toilet. There is a need for a toilet system wherein the toilet seat lid acts as the automatic flushing handle ensuring that the toilet seat will be put back down after use. Such a system should simply connect the lid of a preexisting toilet to the standard flushing system of the toilet to hold the flapper valve open and close the same regardless of the position of the lid.

SUMMARY OF THE INVENTION

It is an object of this invention to provide a lid actuated toilet flushing system adaptable to a preexisting toilet.

It is a further object of this invention to provide such a system which completes the flushing cycle regardless of the position of the lid.

These and other objects are preferably accomplished by providing a pull chain coupled to both the conventional flapper valve of a preexisting toilet tank and the lid of the toilet. The lid must be moved from the up to the down position to flush the toilet and a ratchet mechanism is provided for completing flushing of the toilet even if the lid is left in the down position. The instant system can be utilized with side and front mounted flushing handled toilets.

DESCRIPTION OF THE PREFERRED EMBODIMENT

Figure 1:
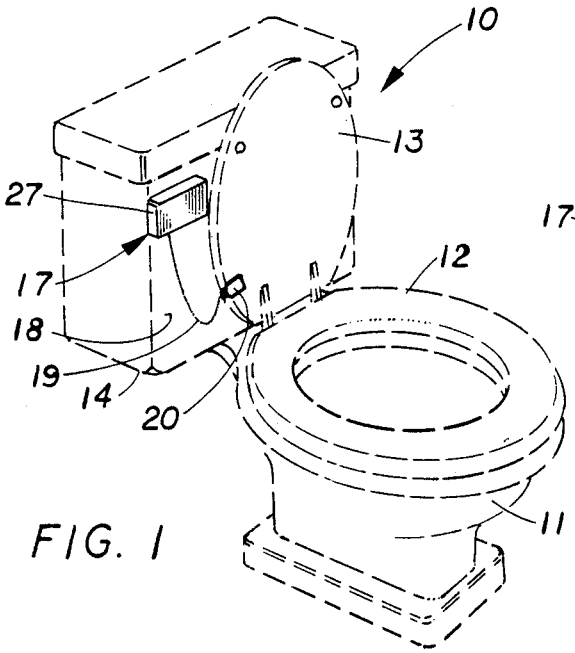
FIG. 1 is a front perspective view of a conventional toilet having the automatic flushing assembly of the invention assembled thereto.
Figure 2:
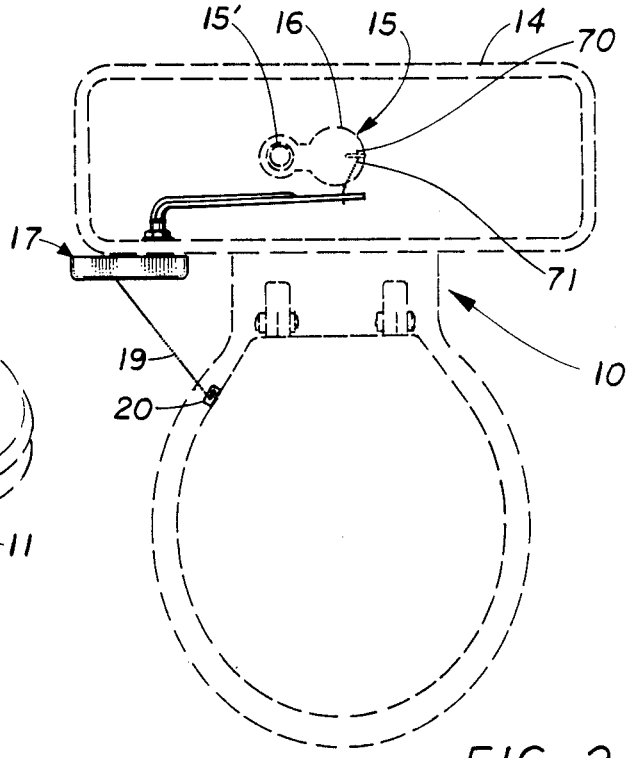
FIG. 2 is a top plan view of the combination of FIG. 1, the lid of the tank being removed for convenience of illustration.

Referring now to FIG. 1 of the drawing, a conventional toilet 10 is shown having a toilet bowl 11, a pivotally mounted toilet seat 12, closure lid 13 and toilet tank 14. As seen in FIG. 2, toilet tank 14 has a conventional flushing assembly 15 in the interior thereof with a conventional flushing flapper 16, and an overflow tube 15'. The normally present remaining parts have been omitted for convenience of illustration. Assembly 15 is of conventional type wherein a lever outside of tank 14 is actuated to open flapper 16 to flush the toilet 10, the flapper 16 returning to a non-flushing position upon release of the lever.

As is known in a conventionally activated toilet upon "flushing" the flapper is raised by hand action to relieve the suction, allowing the water level in the tank to recede (flush out). The next step upon release of the conventional handle is for the flapper to float with water downwardly to a reseat position. It will reseat and stay there as the water level rises in the tank after the hand action has ceased. In this invention the flapper acts in like manner, only being activated (raised) differently.

The foregoing has described a conventional flushing toilet and, other than as set forth hereinbelow in the environment of the invention, and said toilet forms no particular part of the invention and further discussion is deemed unnecessary.

However, it is to be understood that the automatic flushing assembly to be discussed herein can be quickly and easily adapted to any flushing toilet having a flushing tank ball valve or flapper as shown.

Figure 3:
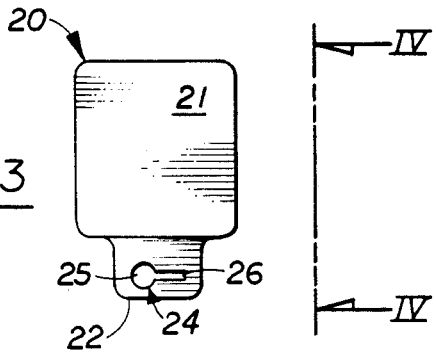
FIG. 3 is a top plan view of the lid attachment member alone of FIG.2.
Figure 4:
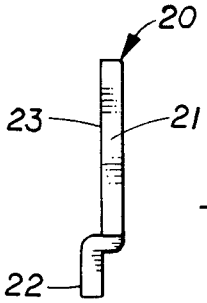
FIG. 4 is a view taken along lines IV—IV of FIG. 3.

Thus, as seen in FIG. 1, a main housing 17 is mounted on the front exterior wall 18 of tank 14. However if the toilet has a side mounted flush handle location, housing 17 would mount at that side location. A chain 19 extends downwardly out of housing 17 through the bottom thereof and is coupled to a lid attachment member 20 (see also FIG. 3). This member 20 has a generally rectangular main body portion 21 with a tab or flange 22 on one side thereof. As seen in FIG. 4, flange 22 is stepped or angled as shown to provide a reduced size area 23 on one side of main body portion 21 for gluing or otherwise securing the member 20 to one edge of the underside of closure lid 13, as seen in FIG. 1 (the reduced area 23 being glued or otherwise secured to lid 13 so that flange 22 is on the outside of lid 13). A key hole slot 24 is provided through flange 22 for receiving one end of chain 19 therein, as seen in FIGS. 1 and 3. Chain 19 is a conventional ball chain having a plurality of spaced balls which are of a diameter to enter hole 25 in slot 24, the links between such balls entering elongated slot portion 26 to releasably retain chain 19 to lid 13.

Figure 5:
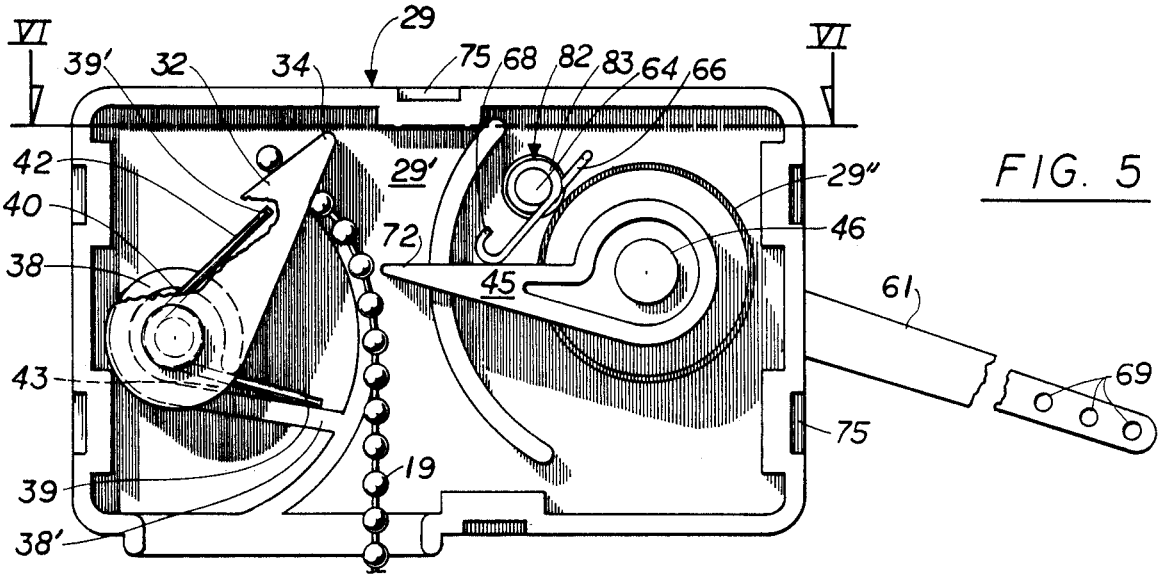
FIG. 5 is a vertical front view of the interior of housing 17, the front cover being omitted for convenience of illustration.
Figures 6, 7, 8:
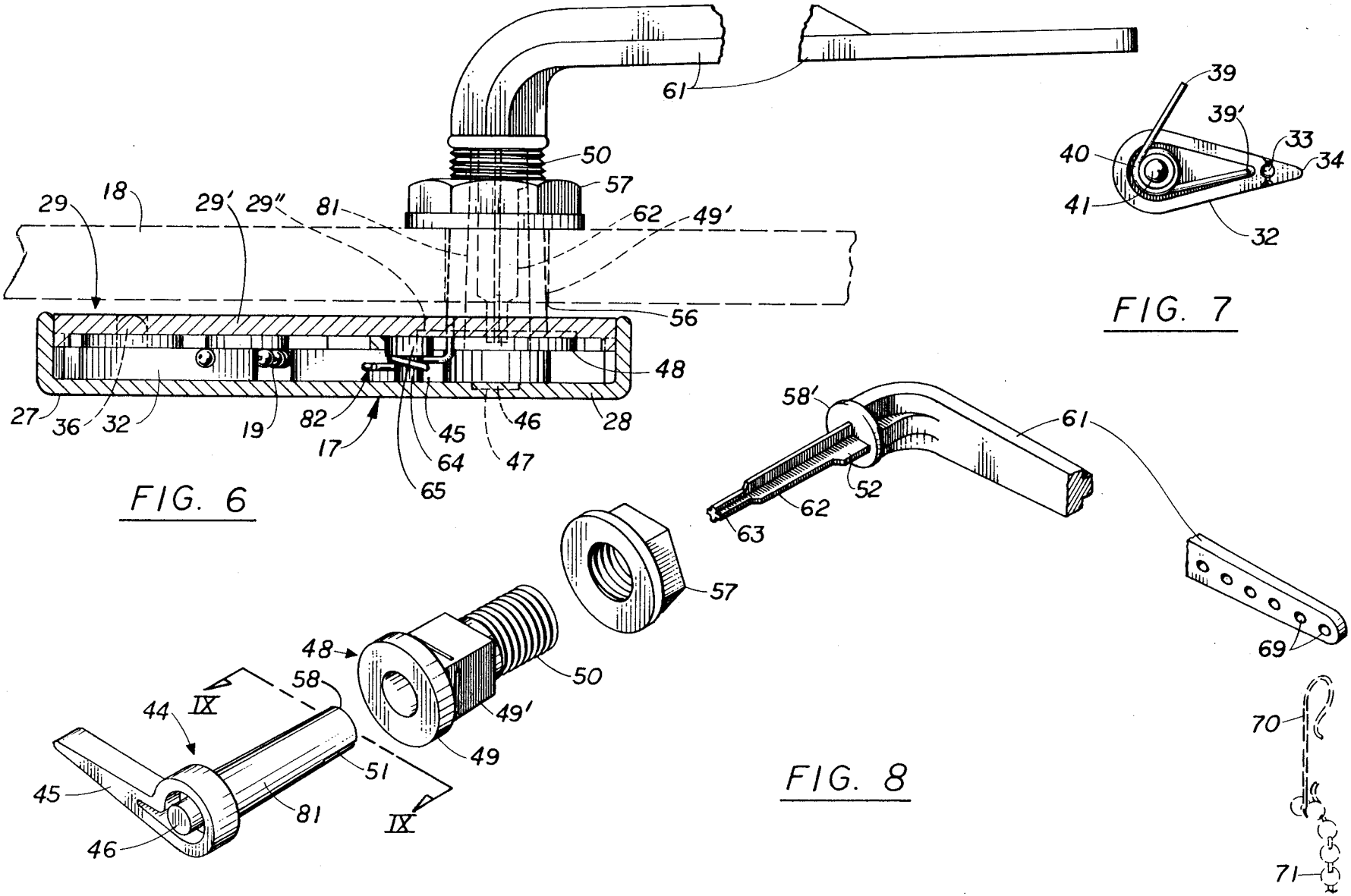
FIG. 6 is a view taken along lines VI—VI of FIG. 5 and including a portion of the wall of the tank and parts of assembly 15 interior of the tank.
FIG. 7 is a view of the opposite side of the pawl 32 alone of FIG. 5.
FIG. 8 is an exploded view of the tooth assembly alone of FIGS. 1 to 8.

As seen in FIG. 6, housing 17 includes a cover 27 and a base plate 29. Cover 27 has a plurality of conventional bosses, not seen, which snappingly engage the recesses 75 located around the perimeter of the forward extending lip 74 of base plate 29 that is disposed normal to wall 29', per FIG. 5. In FIG. 5 the cover 27 of housing 17 has been removed. Alternatively and less preferred, since the housing 17 includes a front cover 27 and a separate spaced base plate 29, fastening of cover 27 may be achieved by using apertured spacers between walls 28 and 29' at each corner to receive a nut and bolt assembly for securing the walls 28, 29' together.

Returning to FIG. 5 a generally triangularly shaped pawl 32 which acts as a flushing lever is pivotally mounted interiorly of housing 17 between walls 28 and 29'. Pawl 32 has a plurality of spaced interconnected cavities 33 (FIG. 7) at its pointed end 34 for receiving the ball links of one end of pull chain 19 therein as seen in FIG. 5. Pawl 32 may be held between walls 28, 29 by a threaded bolt threaded into an internally threaded shaft, or preferably by a built in shaft 36 as per FIG. 6, extending from wall 29'. Shaft 36 is smooth on its exterior so pawl 32 pivots thereon. As seen in FIG. 8, spring 40 curls about the hub 41 of pawl 32 and terminates in an end 39'. As seen in FIG. 5, an annular raised area 38 on base plate wall 29' elevates the pawl 32 above the base plate. At the area proximal to extension portion 38' there is a gap 43 between 38 and 38' in which is received end 39 of spring 40.

Spring 40 thus normally biases pawl tip 34 to the "up" position shown in FIG. 5.

As seen in FIG. 8, tooth 44 includes shaft portion 81 and an integral tooth 45. A cylindrical portion 46 extending above the level of tooth 45 and concentric with shaft 81 may be provided at the free end of tooth 44 and to be receivable in a round opening 47 (FIG. 6) provided in front wall 28. Tooth 45, as seen in FIG. 6, is thus pivotally mounted between front and back walls 28, 29'.

Shaft 81 extends through a mounting bolt 48 which has a molded-in washer head 49 adjacent a tapered square-shaped enlarged seating head 49'; furthermore which bolt 48 has a threaded shaft 50 which engages nut 57. As seen in FIG. 8, seating head 49' is disposed in an opening of and the front wall 18 of the conventional toilet tank 14. The preexisting hole 56 for the toilet's conventional flushing lever—now removed—can be used).

As heretofore mentioned and shown in FIG. 6, shaft 81 extends through the threaded shaft 50 of bolt 48. An internally threaded lock nut 57 is now threaded onto shaft 50, which compresses washer head 49 against recess 29'', thereby providing a firm leak-proof assembly while permitting pivoting of tooth 45. In most instances, however, shaft 50 is above the water line.

As seen in FIG. 8, an elongated flushing rod 61 is provided having an elbow end 59 (FIG. 6) with integral key shaft 62 which is receivable in slotted area 64 of shaft 81. Key shaft 62 and reduced portion 63 and 58 thereon extends through a hole in the nut 52 to a mating slot 64 of shaft 81 of the tooth assembly 44 to thereby engage tooth 45. The key 52 engages the key slot 51 of shaft 81 to provide a locking attachment to the tooth assembly 44.

Figure 9:
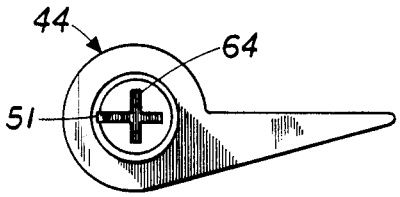
FIG. 9 is a view taken along lines IX—IX of FIG. 8.

As seen in FIG. 9, the terminal end 58 of shaft 81 is recessed with slotted area 64 to receive therein key shaft 62 in its entirety including the reduced portion 63 and end 58 abuts shoulder 58' of flushing rod 61 when assembled (see FIG. 6).

A return spring 82 seen in FIG. 5, but omitted in FIG. 6 is provided having a midportion 83 coiled about a shaft 60 extending from a boss 65 (see FIG. 6). Shaft 60 is lesser in outer diameter, per FIG. 6 than the outer diameter of boss 65 and boss 65 may be secured or otherwise integral with wall 29'. Shaft 64 may also be secured to wall 28 if desired. One end of return spring 82 has a leg portion 66 (FIG. 5) receivable in a hole 67 in wall 29. The other end 68 is generally U-shaped and abuts or bears against tooth 45 as seen. Spring 82 normally biases tooth 45 almost horizontally as seen in FIG. 5.

Obviously, various modifications may occur to an artisan. For example if tooth 45 which acts as a trip lever were removable from shaft 81, then shaft 81 and flushing rod 61 could be made as one piece. As seen in FIGS. 5 and 8, a plurality of spaced apertures 69 may be provided along rod 61 with a hook 70 receivable in one of the apertures 69 and having a chain 71 coupled to flapper 16 connected thereto.

A retrofit of the flushing mechanism of this invention to a conventional toilet may be accomplished by removing the plastic or chrome flushing lever on the exterior of the tank and by coupling the flushing rod 61 to the main housing as shown in FIG. 6.

OPERATION

In order to best understand the operation of the flush assembly of this invention, reference should now be made to both FIG. 5 and to the series of FIGS. 10A through 10F. However prior to discussing the technical aspects of toilet flushing according to this invention, a brief discussion on the use of a toilet bearing this invention is in order.

As has been mentioned previously, the flushing of the toilet according to this invention takes place, when the lid is moved from the up or vertical position to a down or horizontal position. The locus of the toilet seat has no bearing on the operation of this invention. Therefore if one assumes that for best etiquette, the seat is down and the lid is down, then the toilet is not useable and as such the cycle is ready to commence. Thus when little Johnny desires to urinate, he raises the lid and the seat and does his business. The raising of the lid to the open position, relaxes the pull chain 19, allowing the pawl spring 40 to push the pawl 32 i.e the flushing lever to the start position. See FIG. 10A. After Johnny is done, he lowers the toilet seat; and then lowers the lid. This closing of the lid 13, i.e. moving it from the FIG. 1 locus to the FIG. 2 locus, puts a pulling force on the pull chain 19 thereby forcing the pawl 32 to rotate the tooth 45, which fact lifts connecting rod 61 to open the flapper 16, to thus flush the toilet. Now let us go through the procedure in "slow motion" with reference to the figures previously noted.

During the period prior to any flush, the flapper 16 is in the down or at rest position. Little Jane raises the toilet lid 13 to do her thing. The pawl 32 in housing 17 is now in the start position as shown in both FIG. 5 and in FIG. 10A. When she is done, she commences lowering of the toilet lid 13 to the FIG. 2 locus. The chain 19, which is coupled to lid 13 via member 20, pulls the spring biased pawl 32 downwardly as per FIG. 10B. The end 34 of pawl 32 strikes the pointed end 72 of tooth 45, to then move said tooth downwardly about 30 degrees.

While this is happening, the connecting rod 61 leaves its first position and rises about 30 degrees to a second position, and in doing so lifts the flapper 16 which flushes the toilet in conventional style. The flapper 16 then drops back into place and the connecting rod 61 also starts to drop back down 30 degrees to its original first position.

Figure 10A:
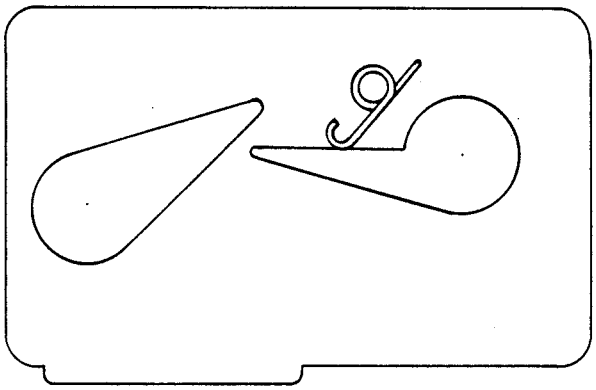
FIG. 10A, B, C, D, E and F illustrate the movement of the various parts during the operation of the flushing assembly of this invention.
Figure 10B:
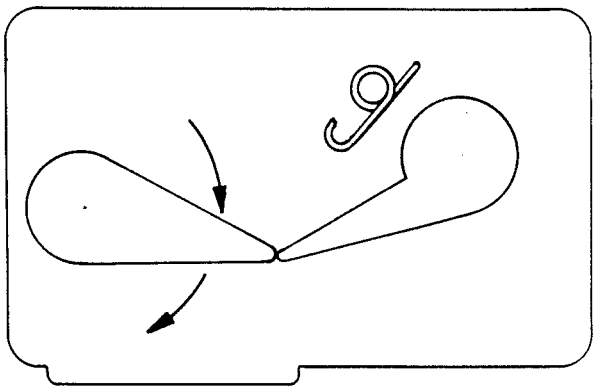
Figure 10C:
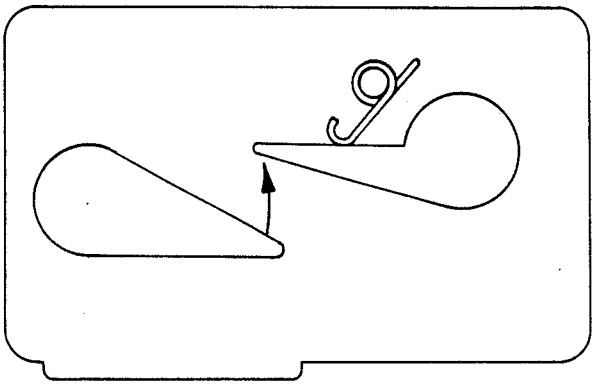

Prior to FIG. 10C, the pawl 32 continues to move down past position on FIG. 10B,—witness the lower directional arrow of FIG. 10B—, and when the pawl is positioned below the tooth 45, the tooth returns to the start position as shown in FIG. 10C, where the pawl is shown to be below the tooth 45. However, due to the bias of the spring 40 the pawl 32 will rise if the tension on the chain is eased. The presence of tooth spring 82 stops the counter rotation of the tooth, and rod 61 reaches its first position, also shown in FIG. 10C. The lid 13 is now fully down.

Figure 10D:
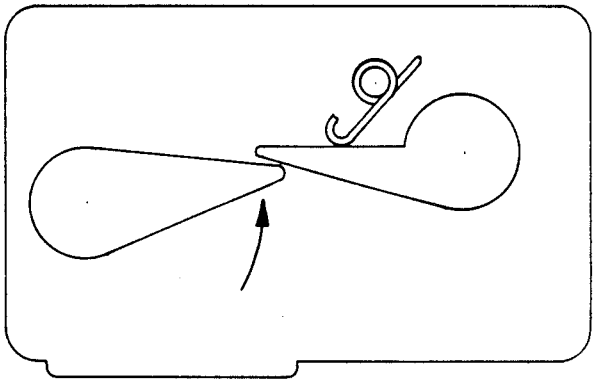
Figure 10E:
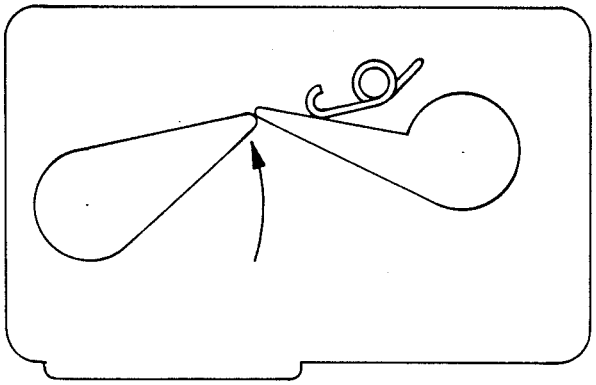
Figure 10F:
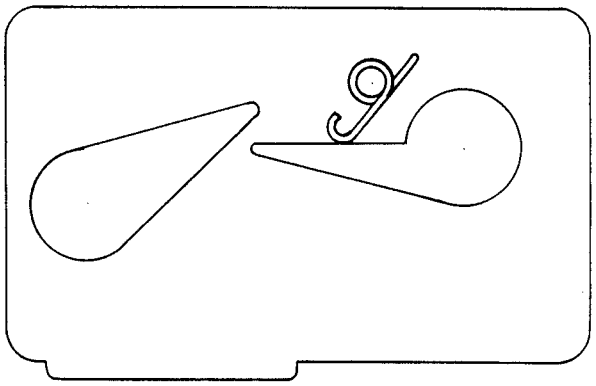

In FIG. 10D, one sees that the pawl 32 in its upward travel, impacts upon the tooth 45 to push the tooth upwardly. Note the location of rod 61. The action continues in FIG. 10E, where the tooth moves upwardly about 10 degrees after impact with the pawl. The tooth spring 82 then compresses; and the pawl still travelling passes by the tooth 45. Once the pawl is past the tooth, the tooth spring 82 relaxes and returns the tooth to its normal position per FIG. 10F. Rod 61 moved slightly downward in reaction to the impact on the tooth 45 by the pawl, per FIG. 10E, but returned to its at rest position as seen in FIG. 10F. The cycle is now over, ready to begin again when and as the lid is raised for the next male or female user of the facility.

The foregoing has described a quick and inexpensive system for flushing a toilet in a manner ensuring that the toilet seat will be put back down after use. The lid operates to flush the toilet in a manner preventing continual flushing even though the lid is in the down position. Any suitable materials, such as plastics, metals, etc. may be used. Although there is disclosed a preferred embodiment of the invention, variations thereof may occur to an artisan and the scope of the invention is only to be limited to the scope of the appended claims. The device herein while shown in the figures as being for a front located flusher toilet, is readily adapted for a side located flusher toilet.

We claim:

1. In an automatic flushing system for a conventional toilet having:

(a) a toilet bowl, (b) a toilet seat mounted to the bowl, (c) a lid for closing the seat, which lid is mounted to the bowl, and which is also movable back and forth from an up, generally vertical position to a down, generally down position, (d) a water tank fluidly coupled to the bowl, and (e) a lever actuated flushing mechanism having a pivotable flushing lever mounted on said tank;

said system also (and) including (f) a trip lever mounted on said tank and actuated by said flushing lever, said trip lever being coupled to a flapper valve adapted to flush water from the tank when in an open position and for stopping the exit of water from the tank when in a closed position, the improvement which comprises:

(g) a lid and means attachment member fixed to said lid and means coupling said lid attachment member to said flushing lever; (and)

said flushing lever comprising a pawl and being resiliently biased in an up position when said lid is in the up position, said flushing lever having a path of downward movement, and (h) a tooth pivotally mounted to said tank, coupled to said trip lever, said tooth having a pointed and extending into the path of downward movement of said flushing lever and normally biased in a horizontal position (.)

said lever actuated flushing system being operated by the movement of said lid from a generally vertical open i.e. up position to a generally horizontal closed i.e. down position whereby when this movement of the lid from an up to a down position transpires, said lid coupled flushing lever comprising a pawl moves downwardly to strike the tooth coupled to said trip lever moving said trip lever and flushing the toilet.

2. In the system of claim 1 wherein said flushing lever and said tooth are mounted in a housing fixed to said tank, at the sight where the flushing handle would be located on said bowl.

3. In the system of claim 2 wherein said means coupling comprises (is fixed to said flushing lever by) a chain extending out of said housing.

4. In the system of claim 2 wherein said housing is open in the front, and has a snap fit cover removably mounted thereover.

5. In the system of claim 1 wherein said tooth is normally biased to a horizontal position by a spring having one end fixed to said housing and the other end abutting against said tooth.

6. In the system of claim 5 wherein said tooth is pivotally mounted to said tank be an elongated shaft extending through said housing and said tank into the interior of said tank, said shaft having said trip lever fixedly secured thereto at an end thereof terminating in the interior of said tank.

7. In the system of claim 6 wherein said shaft has said tooth fixed thereto for pivotal movement within the interior of said housing, said shaft extending from said housing through an aperture formed in the front wall of said tank, and resilient means surrounding said shaft on each side of said front wall for sealing said shaft in said aperture.

8. In the system of claim 7 wherein said shaft includes a threaded portion thereon between said resilient means and said trip lever, and a nut threaded on said threaded portion.

9. In the system of claim 1 wherein said flushing lever has a pointed end extending in a direction toward the pointed end of said tooth, the latter extending toward said pointed end of said flushing lever.

10. In the system of claim 9 wherein each of said pointed ends pivot in a path of movement intersecting the other of said pointed ends whereby one of said pointed ends can abut against the other and move therepast.

* * * * *